US010704516B2

(12) United States Patent
Yamazaki et al.

(10) Patent No.: US 10,704,516 B2
(45) Date of Patent: Jul. 7, 2020

(54) FUEL INJECTION VALVE

(71) Applicant: HITACHI AUTOMOTIVE SYSTEMS, LTD., Hitachinaka-shi, Ibaraki (JP)

(72) Inventors: Akihiro Yamazaki, Isesaki (JP); Takahiro Saito, Isesaki (JP); Nobuaki Kobayashi, Maebashi (JP); Akiyasu Miyamoto, Naka-gun (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 73 days.

(21) Appl. No.: 15/758,093

(22) PCT Filed: Aug. 2, 2016

(86) PCT No.: PCT/JP2016/072641
§ 371 (c)(1),
(2) Date: Mar. 7, 2018

(87) PCT Pub. No.: WO2017/043220
PCT Pub. Date: Mar. 16, 2017

(65) Prior Publication Data

US 2018/0258894 A1 Sep. 13, 2018

(30) Foreign Application Priority Data

Sep. 11, 2015 (JP) ..... 2015-179558

(51) Int. Cl.
*F02M 51/06* (2006.01)

(52) U.S. Cl.
CPC ..... *F02M 51/0682* (2013.01); *F02M 51/06* (2013.01); *F02M 51/0614* (2013.01); *F02M 51/0678* (2013.01); *F02M 51/0632* (2013.01)

(58) Field of Classification Search
CPC ..... F02M 51/0614; F02M 51/06; F02M 51/0682; F02M 51/0678; F02M 51/0632;
(Continued)

(56) References Cited

U.S. PATENT DOCUMENTS 5,127,585 A * 7/1992 Mesenich ..... F02M 45/08 239/585.3
6,607,143 B2 * 8/2003 Dallmeyer ..... F02M 51/0682 239/5
(Continued)

FOREIGN PATENT DOCUMENTS

JP S56-164507 U1 12/1981
JP 2000-145567 A 5/2000
(Continued)

OTHER PUBLICATIONS

Office Action issued in corresponding Indian Patent Application No. 20181700872 dated Feb. 10, 2020.

*Primary Examiner* — Cody J Lieuwen
*Assistant Examiner* — Steven M Cernoch
(74) *Attorney, Agent, or Firm* — Foley & Lardner LLP

(57) ABSTRACT

The present invention includes a valve seat and a valve body that cooperatively open/close a fuel passage, a movable element having the valve body provided at one end part thereof and a movable iron core 27*a* provided at the other end part thereof, a fixed iron core 25 which faces the movable iron core 27*a* and which attracts the movable iron core 27*a* by applying a magnetic attraction force thereto, and a cylindrical member that includes thereinside the fixed iron core 25 and the movable iron core 27*a*. The fixed iron core 25 includes a reduced-diameter part 25*m* on an outer circumferential surface at the side facing the movable iron core 27*a*, and the movable iron core 27*a* includes a reduced-
(Continued)

diameter part 27*am* on an outer circumferential surface at the side facing the fixed iron core 25.

15 Claims, 7 Drawing Sheets

(58) Field of Classification Search
CPC ... F02M 2200/9069; F02M 2200/8061; F02M 2200/08; F02M 63/0078; F02M 63/0021; F02M 61/168; F02M 51/0667; F02M 61/10; H01F 7/1607; H01F 7/081
See application file for complete search history.

(56) References Cited

U.S. PATENT DOCUMENTS

| | | | | |
|---|---|---|---|---|
| 6,851,622 | B2 * | 2/2005 | Demere | F02M 51/005 239/5 |
| 7,721,713 | B2 | 5/2010 | Hayatani | |
| 10,024,287 | B2 * | 7/2018 | Grandi | F02M 51/0614 |
| 2003/0127544 | A1 | 7/2003 | Demere et al. | |
| 2005/0140480 | A1 | 6/2005 | Yamamoto et al. | |

FOREIGN PATENT DOCUMENTS

| | | | |
|---|---|---|---|
| JP | 2002-004971 | A | 1/2002 |
| JP | 2005-515347 | A | 5/2005 |
| JP | 2005-207412 | A | 8/2005 |
| WO | WO-2009/090794 | A1 | 7/2009 |

* cited by examiner

FUEL INJECTION VALVE

TECHNICAL FIELD

The present invention relays to a fuel injection valve for injecting fuel.

BACKGROUND TECHNOLOGY

As a background technology of the present technical field, a fuel injection valve described in Japanese patent application publication No. 2005-207412 (patent document 1) has been known. In this fuel injection valve, the outer circumferences of a movable core and a fixed core are covered with a cylindrical member disposed inside a coil, and a magnetic circuit is formed by the cylindrical member, the movable core and the fixed core. The fixed core is provided with a tapered part on the opposite side to the movable core and with a large diameter part on the anti-movable core side of the tapered part. The outer diameter of the tapered part becomes large from the facing end surface side facing the movable core toward the large diameter part. The outer diameter of the facing end surface of the tapered part which faces the movable core is substantially equal to the outer diameter of the movable core. The outer diameter of the large diameter part of the fixed core is larger than that of the movable core, and the magnetic path area of the large diameter part is larger than that on the opposite side of the movable core to the fixed core (see abstract).

With this, in the fuel injection valve of the patent document 1, the magnetic path area on the anti-movable core side (large diameter part) of the fixed iron core is set to be larger than the magnetic path area on the opposite side to the fixed core of the movable core (movable iron core), and the magnetic flux quantum flowing between the movable core and the fixed core is increased, and thereby valve opening response is improved (see paragraph [0029]). In addition, by recessing the facing end surface side of the fixed core which faces the movable iron core radially inward by the tapered part, the area of the facing end surface facing the movable core becomes small, and a part of the magnetic flux is suppressed from flowing between a member covering the outer circumference of the movable core and the fixed core (see paragraph [0030]). Moreover, in the fuel injection valve of the patent document 1, the tapered part acts as a magnetic throttle, and it is possible to limit the flow of the magnetic flux between the movable core and the fixed core beyond the required quantum, and consequently, a saturated attractive force can be reduced. Therefore, the remaining magnetic flux is reduced, and thereby valve closing response is improved (see paragraph [0031]).

PRIOR ART DOCUMENT

Patent Document

Patent Document 1: Japanese Patent Application Publication 2005-207412

SUMMARY OF THE INVENTION

Task to be Solved by the Invention

In the fuel injection valve of the patent document 1, it is realized that the valve opening response is improved by the increase of the magnetic quantum by providing the tapered part on the outer circumferential surface side of the fixed core (fixed iron core), the leakage of the magnetic flux flowing between the member covering the outer circumference of the movable core and the fixed core is suppressed, and that the valve closing response is improved by decreasing the remaining magnetic flux quantum.

However, in the fuel injection valve 1, it is not considered to provide a magnetic throttle on the movable iron core (movable core) side. By providing a magnetic throttle not only to the fixed iron core but also on the movable iron core side, the operation of the valve body can be in a more preferable state with a magnetic circuit (magnetic passage) formed by the movable core, the fixed core and the cylindrical member covering the outer circumference of the movable core and the fixed core.

An object of the present invention is to provide a fuel injection valve capable of improving the response of valve body operation.

Means for Solving the Task

To achieve the above object, the fuel injection valve of the present invention includes:

- a valve seat and a valve body that cooperatively open and close a fuel passage;
- a movable element including the valve body provided at one end part thereof and a movable iron core provided at the other end part thereof;
- a fixed iron core which faces the movable iron core and which attracts the movable iron cure by applying a magnetic attraction force to the movable iron core; and
- a cylindrical member including thereinside the fixed iron core and the movable iron core,
- wherein the fixed iron core includes a reduced-diameter part on an outer circumferential surface at a side facing the movable iron core, and
- wherein the movable iron core includes a reduced-diameter part on an outer circumferential surface at a side facing the fixed iron core.

Effects of the Invention

According to the present invention, a fuel injection valve excellent in the response of the valve body operation can be provided.

MODE FOR IMPLEMENTING THE INVENTION

An embodiment according to the present invention will be explained with reference to FIG. 1 to FIG. 3.

The whole configuration of a fuel injection valve 1 will be explained with reference to FIG. 1. FIG. 1 is a sectional view showing a cross section along a central axis 1*a* in one embodiment of the fuel injection valve according to the present invention. In addition, the central axis 1*a* corresponds to the axis (valve axis) of a movable element (valve assembly) 27 provided integrally with a valve body 27*c*, a rod part (connection part) 27*b* and a movable iron core (movable core) 27*a*, and to the central axis of a cylindrical body 5.

Figure 1:
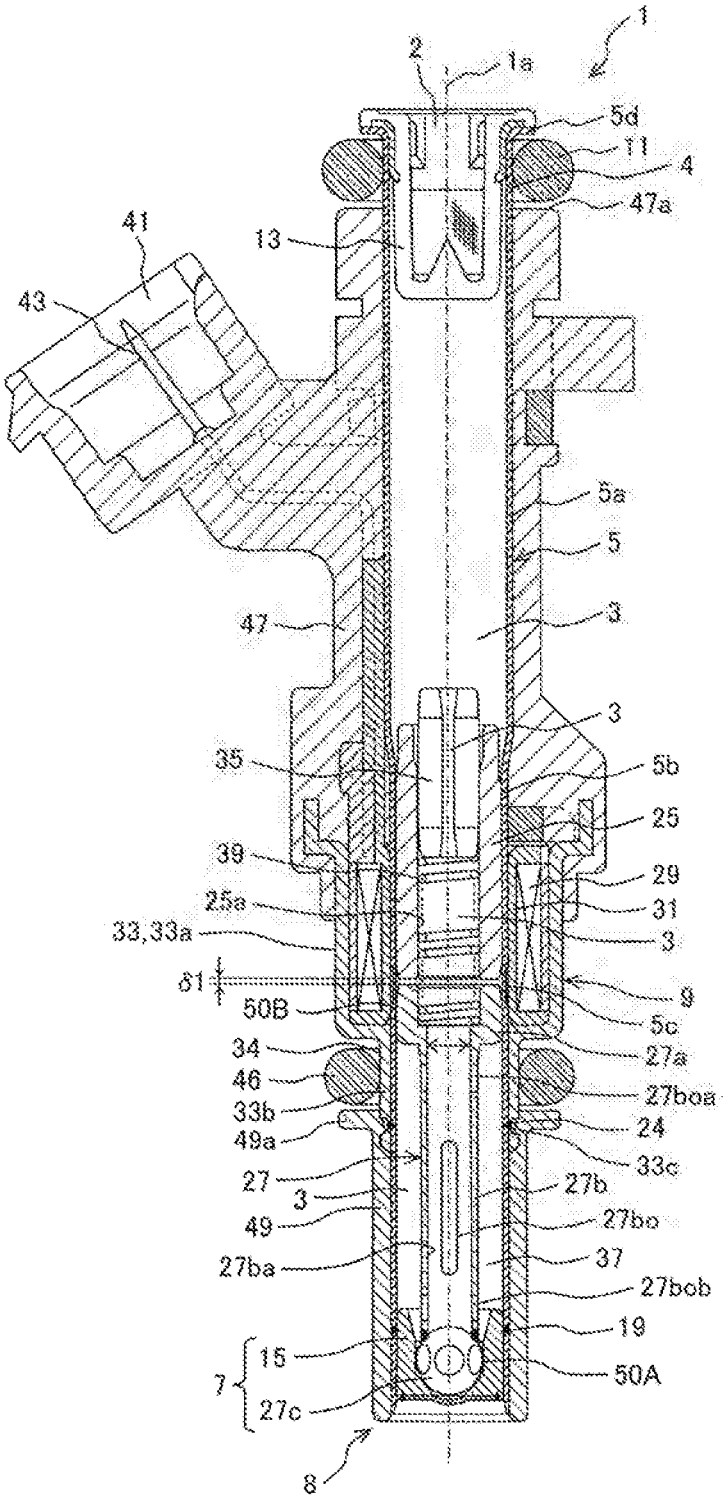
FIG. 1 is a sectional view showing a cross section along an central axis 1*a* in one embodiment of a fuel injection valve according to the present invention.
Figure 2:
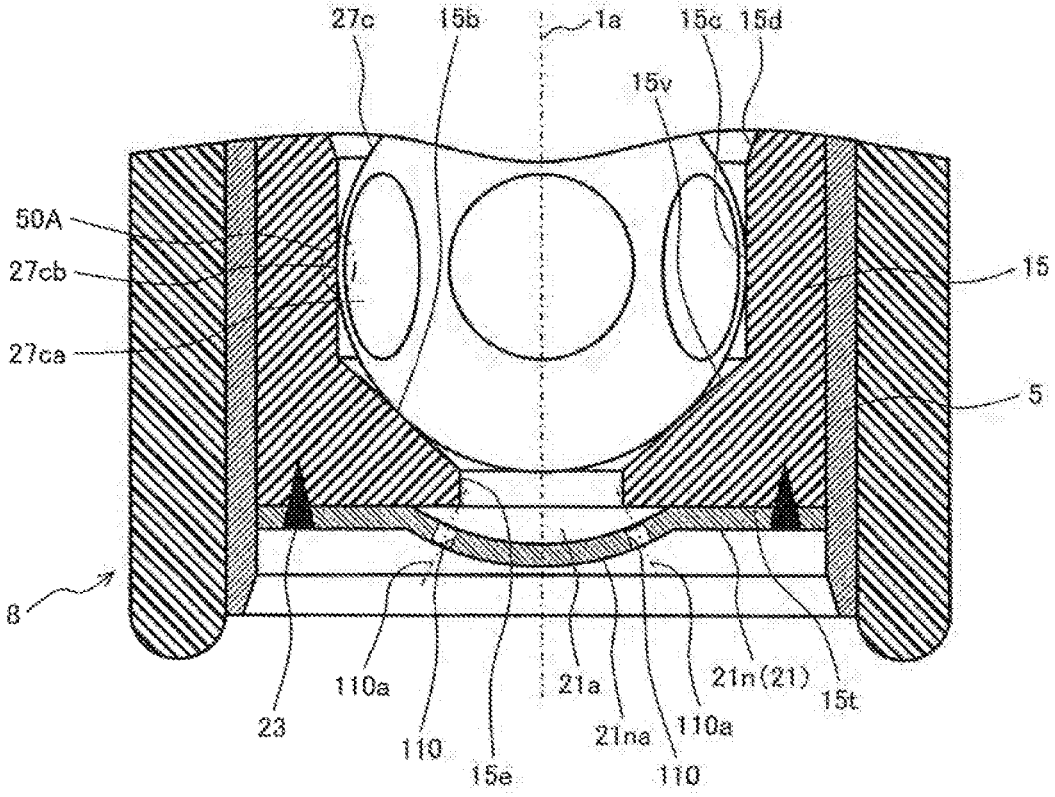
FIG. 2 is a sectional view showing the enlarged vicinity of a nozzle part 8 shown in FIG. 1.

In FIG. 1, the upper end part (upper end side) of the fuel injection valve 1 is called a base end part (base end side), and the lower end part (lower end side) of the fuel injection valve 1 is called a distal end part (distal end side). The terms "the base end part (base end side)" and "the distal end part (distal end side)" are determined based on the flow direction of fuel or on the fitting structure of the fuel injection valve 1 to a fuel pipe. In addition, an up-and-down relation explained in the present specification is based on FIG. 1, and it is not related to a vertical direction (up-and-down direction) of a mode in which the fuel injection valve 1 is mounted on an internal combustion engine.

In the fuel injection valve 1, by the cylindrical body (cylindrical member) 5 made of metal, a fuel flow passage (fuel passage) 3 is formed in its inside in a direction substantially along the central axis 1*a*. The cylindrical body 5 is formed in a shape having a stop in the direction long the central axis 1*a* by press working such as deep-drawing by using metals such as stainless steel having magnetism. With this, the diameter of a one end side 5*a* of the cylindrical body 5 is larger than that of an other end side 5*b* thereof. That is, the outer circumferential surface and an inner circumferential surface 5*e* of the cylindrical body 5 are each formed in a cylindrical shape.

The base end part of the cylindrical body 5 is provided with a fuel supply port 2, and a fuel filter 13 is attached to the fuel supply port 2 to remove foreign substances mixed in the fuel.

The base end part of the cylindrical body 5 is formed with a flange part (enlarged diameter part) 5*d* formed by being bent such that the diameter of the base end part of the cylindrical body 5 is enlarged radially outward. An O-ring 11 is disposed on an annular concave part (annular groove part) 4 formed of the flange part 5*d* and a base-end-side end part 47*a* at a resin cover 47.

The distal end part of the cylindrical body 5 is formed with a valve part 7 formed of the valve body 27*c* and a valve seat member 15. The valve seat member 15 is inserted into the inside on the distal end side of the cylindrical body 5, and is fixed to the cylindrical body 5 through a laser welding part 19 formed by laser welding. The laser welding part 19 is formed over the entire circumference from the outer circumferential side of the cylindrical body 5. In this case, the valve seat member 15 may be fixed to the cylindrical body 5 by the laser welding after the valve seat member 15 is press-fitted into the inside on the distal end side of the cylindrical body 5.

A drive part 9 for driving the valve body 27*c* is disposed in the middle part of the cylindrical body 5. The drive part 9 is formed by an electromagnetic actuator (electromagnetic drive part). Specifically, the drive part 9 is formed of a fixed iron core (fixed core) 25 fixed to the inside (inner circumferential side) of the cylindrical body 5, the movable element (movable member) 27 which is arranged on the distal end side to the fixed iron core 25 in the cylindrical body 5 and which can move in the direction along the central axis 1*a*, an electromagnetic coil 29 fitted onto the outer circumferential side of the cylindrical body 5 at the position at which the fixed iron core 25 faces the movable iron core (movable core) 27*a* formed in the movable element 27 via a minute gap δ, and of a yoke 33 covering the electromagnetic coil 29 from the outer circumferential side of the electromagnetic coil 29.

The movable element 27 is accommodated in the cylindrical body 5, and the cylindrical body 5 faces the outer circumferential surface of the movable iron core 27*a*, and encloses the movable iron core 27*a*. The cylindrical body 5, the valve seat member 15 and the fixed iron core 25 form a valve housing accommodating the movable element 27.

The movable iron core 27*a*, the fixed iron core 25 and the yoke 33 form a closed magnetic path (magnetic circuit) through which a magnetic flux generated by energizing the electromagnetic coil 29 flows. The magnetic flux passes through the minute gap δ. However, a nonmagnetic part or weak magnetic part 5*c* having magnetism weaker than the other parts of the cylindrical body 5 is disposed at a position (outer circumferential side of the minute gap δ) of the cylindrical body 5 which corresponds to the minute gap δ, to reduce a leakage magnetic flux flowing through the cylindrical body 5 at a part of the minute gap δ. In the following, this nonmagnetic part or weak magnetic part 5*c* is simply called the nonmagnetic part 5*c*, and it will be explained. The nonmagnetic part 5*c* can be formed by non-magnetizing the cylindrical body 5 having magnetism to the cylindrical body 5. This non-magnetization can be performed by, for example, heat treatment, or the nonmagnetic part 5*c* can be formed by reducing the thickness of a part corresponding to the nonmagnetic part 5*c* by forming an annular concave part on the outer circumferential surface of the cylindrical body 5. In the present embodiment, an embodiment in which the nonmagnetic part 5*c* is formed by the annular concave part is shown.

The electromagnetic coil 29 is wound around a bobbin 31 made of a resin material and formed in a cylindrical shape, and fitted onto the outer circumferential side of the cylindrical body 5. The electromagnetic coil 29 is electrically connected to a terminal 43 disposed in a connector 41. An external drive circuit which is not shown in the drawings is connected to the connector 41, and drive current is fed to the electromagnetic coil 29 via the terminal 43.

The fixed iron core 25 is made of a magnetic metal material. The fixed iron core 25 is formed in a cylindrical shape, and has a through hole 25*a* penetrating through the center part thereof in the direction along the central axis 1*a*. The fixed iron core 25 is press-fitted and fixed on the base end side of the small diameter part 5*b* of the cylindrical body 5, and positioned in the middle part of the cylindrical body 5. The large diameter part 5*a* is provided on the base end side of the small diameter part 5*b*, and thereby the attachment of the fixed iron core 25 becomes easy. The fixed iron core 25 may be fixed to the cylindrical body 5 by welding, or may be fixed to the cylindrical body 5 by using welding with press-fitting.

The movable element (valve assembly) 27 is formed of the movable iron core 27*a*, the rod part (connection part) 27*b* and the valve body 27*c*. The movable iron core 27*a* is an annular member. The valve body 27*c* is a member which comes into contact with a valve seat 15*b* (see FIG. 2). The valve seat 15*b* and the valve body 27*c* cooperatively open and close a fuel passage. The rod 27*b* has a long narrow cylindrical shape, and is a connection part connecting the movable iron core 27*a* with the valve body 27*c*. The movable iron core 27*a* is connected with the valve body 27*c*, and drives the valve body 27*c* in a valve opening/closing direction by a magnetic attraction force applied between the movable iron core 27*a* and the fixed iron core 25.

In the present embodiment, although the rod part 27*b* and the movable iron core 27*a* are formed by one member, they may be formed by different members from each other and then are integrally assembled. In addition, in the present embodiment, the rod part 27*b* and the valve body 27*c* are formed by different members from each other, and the valve body 27*c* is fixed to the rod part 27*b*. The fixing of the valve body 27*c* to the rod part 27*b* is performed by press-insertion or welding. The rod part 27*b* and the valve body 27*c* may be thinned integrally by one member.

The rod part 27*b* has a cylindrical shape, and has a hole 27*ba* which is opened to the upper end of the rod part 27*b*, and which extends in an axial direction. A communication hole (opening part) 27*bo* communicating the inside with the outside is formed to the rod part 27*b*. A back pressure chamber 37 is formed between the outer circumferential surface of the rod part 27*b* and the inner circumferential surface of the cylindrical body 5. A fuel passage 3 inside the through hole 25*a* of the fixed iron core 25 communicates with the back pressure chamber 37 via the hole 27*ba* and the communication hole 27*bo*. The hole 27*ba* and the communication hole 27*bo* form a fuel passage 3 communicating the fuel passage 3 inside the through hole 25*a* with the back pressure chamber 37.

A coil spring 39 is disposed in the through hole 25*a* of the fixed iron core 25. One end of the coil spring 39 comes into contact with a spring seat 27*ag* (see FIG. 3) provided inside the movable iron core 27*a*. The other end of the coil spring 39 comes into contact with an adjuster (adjuster element) 35 disposed inside the through hole 25*a* of the fixed iron core 25. The coil spring 39 is disposed in a compressed state between the spring seat 27*ag* and the lower end (end surface on the distal end side) of the adjuster (adjuster element) 35.

The coil spring 39 functions as a biasing member for biasing the movable element 27 in the direction in which the valve body 27*c* comes into contact with the valve seat 15*b* (see FIG. 2) (valve closing direction) By adjusting the position of the adjuster 35 in the through hole 25*a* in the direction along the central axis 1*a*, the biasing force of the movable element 27 (that is, the valve body 27*c*) by the coil spring 39 is adjusted.

The adjuster 35 has a fuel flow passage 3 penetrating through the center part of the adjuster 35 in the direction along the central axis 1*a*. The fuel supplied from the fuel supply port 2, after flowing through the fuel flow passage 3 of the adjuster 35, flows through the fuel flow passage 3 at the distal end side part of the through hole 25*a* of the fixed iron core 25, and then flows through the fuel flow passage 3 formed inside the movable element 27.

The yoke 33 is made of a metal material having magnetism, and also serves as a housing of the fuel injection valve 1. The yoke 33 is formed in a cylindrical stepped shape having a large diameter part 33*a* and a small diameter part 33*b*. The large diameter part 33*a* covers the outer circumference of the electromagnetic coil 29 and has a cylindrical shape, and the small diameter part 38*b* having a smaller diameter than the large diameter part 33*a* is formed on the distal end side of the large diameter part 33*a*. The small diameter part 33*b* is press-fitted onto the outer circumference of the small diameter part 5*b* of the cylindrical body 5. With this, the inner circumferential surface of the small diameter part 33*b* comes into tight contact with the outer circumferential surface of the cylindrical body 5. At this time, at least a part of the inner circumferential surface of the small diameter part 33*b* faces the outer circumferential surface of the movable iron core 27*a* via the cylindrical body 5, and magnetic resistance of a magnetic path formed at this facing part is lowered.

An annular concave part 33*c* is formed on the outer circumferential surface of the end part on the distal end side of the yoke 33 along a circumferential direction. In a thin part formed on the bottom surface of the annular concave part 33*c*, the yoke 33 and the cylindrical body 5 are joined over the entire circumference via a laser welding part 24 formed by laser welding.

A cylindrical protector 49 having a flange part 49*a* is fitted onto the distal end part of the cylindrical body 5, and the distal end part of the cylindrical body 5 is protected by the protector 49. The protector 49 covers the laser welding part 24 of the yoke 33.

An annular groove 34 is formed of the flange part 49*a* of the protector 49, the small diameter part 33*b* of the yoke 33 and the stepped surface between the large diameter part 33*a* and the small diameter part 33*b* of the yoke 33, and an O-ring 46 is fitted onto the annular groove 34. The O-ring 46 functions as a seal for securing liquid-tightness and airtightness between the inner circumferential surface of an insertion port formed in an internal combustion engine side and the outer circumferential surface of the small diameter part 33*b* in the yoke 33, when the fuel injection valve 1 is attached to the internal combustion engine.

The resin cover 47 is molded in a range from the middle part to a part close to the end part on the base end side of the fuel injection valve 1. The end part on the distal end side of the resin cover 47 covers a part on the base end side of the large diameter part 33*a* of the yoke 33. In addition, by the resin forming the resin cover 47, the connector 41 is integrally formed.

Next, the configuration of the nozzle part 8 will be explained in detail with reference to FIG. 2. FIG. 2 is a sectional view showing the enlarged vicinity of the nozzle part 8 shown in FIG. 1.

Through holes 15*d*, 15*c*, 15*v* and 15*e* penetrating in the direction along the central axis 1*a* are formed in the valve seat member 15. The conical surface 15*v* whose diameter is reduced toward a downstream side is formed in the midway of these through holes. The valve seat 15*b* is formed above the conical surface 15*v*, and the valve body 27*c* comes into contact with and is separated from the valve seat 15*b*, and the opening/closing of the fuel passage is performed. In addition, there is a case where the conical surface 15*v* formed with the valve seat 15*b* is called a valve seat surface.

Moreover, the valve seat 15*b* and a part of the valve body 27*c* which comes into contact with the valve seat 15*b* are called a seal part.

The hole parts 15*d*, 15*c* and 15*v* on the upper side from the conical surface 15*v* of the through holes 15*d*, 15*c*, 15*v* and 15*e* form a valve accommodating hole accommodating the valve body 27*c*. The guide surface 15*c* which guides the valve body 27*c* in the direction along the central axis 1*a* is formed on the inner circumferential surfaces of the valve accommodating holes 15*d*, 15*c* and 15*v*.

The downstream-side guide surface 15*c* and a slide contact surface 27*cb* of the valve body 27*c* which slides in contact with the downstream-side guide surface 15*c* form a downstream-side guide part 50A for guiding the displacement of the movable element 27.

The enlarged diameter part 15*d* whose diameter is enlarged toward an upstream side is formed on the upstream side of the guide surface 15*c*. By the enlarged diameter part 15*b*, the attachment of the valve body 27*c* becomes easy, and the enlarged diameter part 15*d* helps to enlarge the cross section of the fuel passage. On the other hand, the lower end parts of the valve accommodating holes 15*d*, 15*c* and 15*v* are connected to the fuel introduction hole 15*e*, and the lower end surface of the fuel introduction hole 15*e* is opened to a distal end surface 15*t* of the valve seat member 15.

The distal end surface 15*t* of the valve seat member 15 is attached with a nozzle plate 21*n*. The nozzle plate 21*n* is fixed to the valve seat member 15 by a laser welding part 23. The laser welding part 28 is formed around the circumference of an injection hole forming region at which fuel injection holes 110 are formed, so as to surround the injection hole forming region.

In addition, the nozzle plate 21*n* is formed by a plate-shaped member (flat plate) having a uniform thickness, and a projecting part 21*na* projecting outward is formed in the middle part of the nozzle plate part 21*n*. The projecting part 21*na* is formed by a curved surface (for example, a spherical surface). A fuel chamber 21*a* is formed inside the projecting part 21*na*. This fuel chamber 21*a* communicates with the fuel introduction hole 15*e* formed in the valve seat member 15, and the fuel is supplied to the fuel chamber 21*a* through the fuel introduction hole 15*e*.

The projecting part 21*na* is formed with a plurality of the fuel injection holes 110. The form of each of the fuel injection holes is not limited. A swirl chamber for imparting swirl force to the fuel may be provided on the upstream side of the fuel injection holes 110. A central axis 110*a* of each of the fuel injection holes may be parallel to the central axis 1*a* of the fuel injection valve or may be inclined relative to the central axis 1*a* of the fuel injection valve. In addition, the projecting part 21*na* may not be formed.

In the present embodiment, the valve part 7 for opening/closing the fuel injection holes 110 is formed of the valve seat member 15 and the valve body 27*c*. A fuel injection part 21 determining the shape of fuel injection spray is formed of the nozzle plate 21*n*. In addition, the valve part 7 and the fuel injection part 21 form the nozzle part 8 for performing fuel injection. That is, the nozzle plate 21*n* is joined to the distal end part 15*t* on the main body side (valve seat member 15) of the nozzle part 8, and the nozzle part 8 in the present embodiment is configured.

In the present embodiment, a ball valve having a spherical shape is used as the valve body 27*c*. In the valve body 27*c*, a part facing the guide surface 15*c* is provided with a plurality of notched surfaces 27*ca* formed at intervals in a circumferential direction, and a fuel passage is formed by these notched surfaces 27*ca*. The valve body 27*c* can be formed by a valve body other than the ball valve. For example, a needle valve may be used.

The configuration of the vicinity of the movable iron core 27*a* of the movable element 27 will be explained in detail with reference to FIG. 3. FIG. 3 is an enlarged sectional view showing the enlarged vicinity of the movable iron core 27*a* and the fixed iron core 25 shown in FIG. 1. In addition, FIG. 3 shows a state in which a central axis (valve axis) 27*l* of the movable element 27 corresponds to the central axis 1*a* of the fuel injection valve 1.

In the present invention, the movable iron core 27*a* and the rod part 27*b* are integrally formed by one member. A concave part 27*aa* recessed downward is formed in the middle part of an upper end surface 27*ab* of the movable iron core 27*a*. A spring seat 27*ag* is formed on the bottom part of the concave part 27*aa*, and one end of the coil spring 39 is supported on the spring seat 27*ag*. In addition, an opening part 27*af* communicating with the inside of the rod part 27*b* is formed on the bottom part of the concave part 27*aa*. The opening part 27*af* forms a fuel passage, and the fuel which flows from the through hole 25*a* of the fixed iron core 25 into a space 27*ai* inside the concave part 27*aa* flows through this fuel passage, and then flows to a space 27*bi* inside the rod part 27*b*.

The upper end surface 27*ab* of the movable iron core 27*a* faces a lower end surface 25*b* of the fixed iron core 25. The upper end surface 27*ab* and the lower end surface 25*b* form magnetic attraction surfaces, and a magnetic attraction force is applied therebetween. An outer circumferential surface 27*ac* of the movable iron core 27*a* is formed so as to slide in contact with the inner circumferential surface 5*e* of the cylindrical body 5. That is, the inner circumferential surface 5*e* surrounds the movable iron core 27*a* and forms a guide surface for guiding the movement of the movable element 27 in the valve opening/closing direction. In particular, the inner circumferential surface 5*e* forms an upstream-side guide surface with which the outer circumferential surface 27*ac* of the movable iron core 27*a* slides in contact. The upstream-side guide surface 5*e* and the outer circumferential surface 27*ac* of the movable iron core 27*a* form an upstream-side guide part 50B for guiding the displacement of the movable element 27.

In the present embodiment, the movement of the movable element 27 in the valve opening/closing direction is guided by two points of the guide surface (downstream-side guide surface) 15*c* formed in the valve seat member 15 and the upstream-side guide surface 5*e* formed of the inner circumferential surface of the cylindrical body 5. That is, the movable element 27 is guided by two points of the upstream-side guide part 50B and the downstream-side guide part 50A (see FIG. 1), and reciprocates in the direction of the central axis 1*a*. In this case, the valve body 27*c* of the movable element 27 is guided by the downstream-side guide surface 15*c*, and the outer circumferential surface 27*ac* of the movable iron core 27*a* is guided by the upstream-side guide surface 5*c*.

A feature of each of the fixed iron core 25 and the movable iron core 27*a* according to the present invention will be specifically explained with reference to FIG. 3 to FIG. 5. FIG. 4 is an enlarged sectional view showing the enlarged facing part (IV part) between the movable iron core 27*a* and the fixed iron core 25 shown in FIG. 3. FIG. 5 is an enlarged sectional view showing the enlarged vicinity (V part) of the movable iron core 27*a* shown in FIG. 3.

The fixed iron core 25 is formed with a magnetic throttling part 25*m* on the outer circumferential part at a facing end surface 25*b* side facing the movable iron core 27*a*. In the present invention, the magnetic throttling part 25*m* is formed by a tapered surface (tapered part). The tapered surface 25*m* is formed so as to gradually reduce the outer diameter of the fixed iron core 25 from the opposite side to the side facing the movable iron core 27*a* (hereinafter, it is called an anti-movable iron core side) toward the facing end surface 25*b*. That is, in the tapered surface 25*m*, the outer diameter is reduced from the anti-movable iron core side toward the facing end surface 25*b*. Consequently, a space 25*s* is formed between the inner circumferential surface 5*e* of the cylindrical body 5 and the fixed iron core 25, on the outer circumferential side of the fixed iron core 25. The space 25*s* is formed such that the space between the inner circumferential surface 5*e* and the fixed iron core 25 is expanded from the anti-movable iron core side toward the facing end surface 25*b* (movable iron core 27*a*).

Chamfering is performed to the inner circumferential part of the facing end surface 25*b* of the fixed iron core 25 to remove a corner. In the present invention, a corner portion of the inner circumference of the facing end surface 25*b* is diagonally cut by the chamfering, and an inclined surface 25*n* having a narrow width is formed.

The movable iron core 27*a* is formed with a magnetic throttling part 27*am* on the outer circumferential part at a facing end surface 27*ab* side facing the fixed iron core 25. In the present embodiment, the magnetic throttling part 27*am* is formed by a tapered surface (tapered part). The tapered surface 27*am* is formed such that the outer diameter of the movable iron core 27*a* is gradually reduced from the opposite side to the side facing the fixed iron core 25 (hereinafter, it is called an anti-fixed iron core side) toward the facing end surface 27*ab*. That is, in the tapered surface 27*am*, the outer diameter of the movable iron core 27*a* is reduced from the anti-fixed iron core side toward the facing end surface 27*ab*. Consequently, a space 27*as* is formed between the inner circumferential surface 5*e* of the cylindrical body 5 and the movable iron core 27*a*, on the outer circumferential side of the movable iron core 27*a*. The space 27*as* is formed such that the space between the inner circumferential surface 5*e* and the movable iron core 27*a* is expanded from the anti-fixed iron core side toward the facing end surface 27*ab* (fixed iron core 25).

Chamfering is performed to the inner circumferential part of the facing end surface 27*ab* of the movable iron core 27*a* to remove a corner. In the present invention, a corner portion of the inner circumference of the facing end surface 27*ab* is diagonally cut by the chamfering, and an inclined surface 27*an* having a narrow width is formed.

Figure 3:
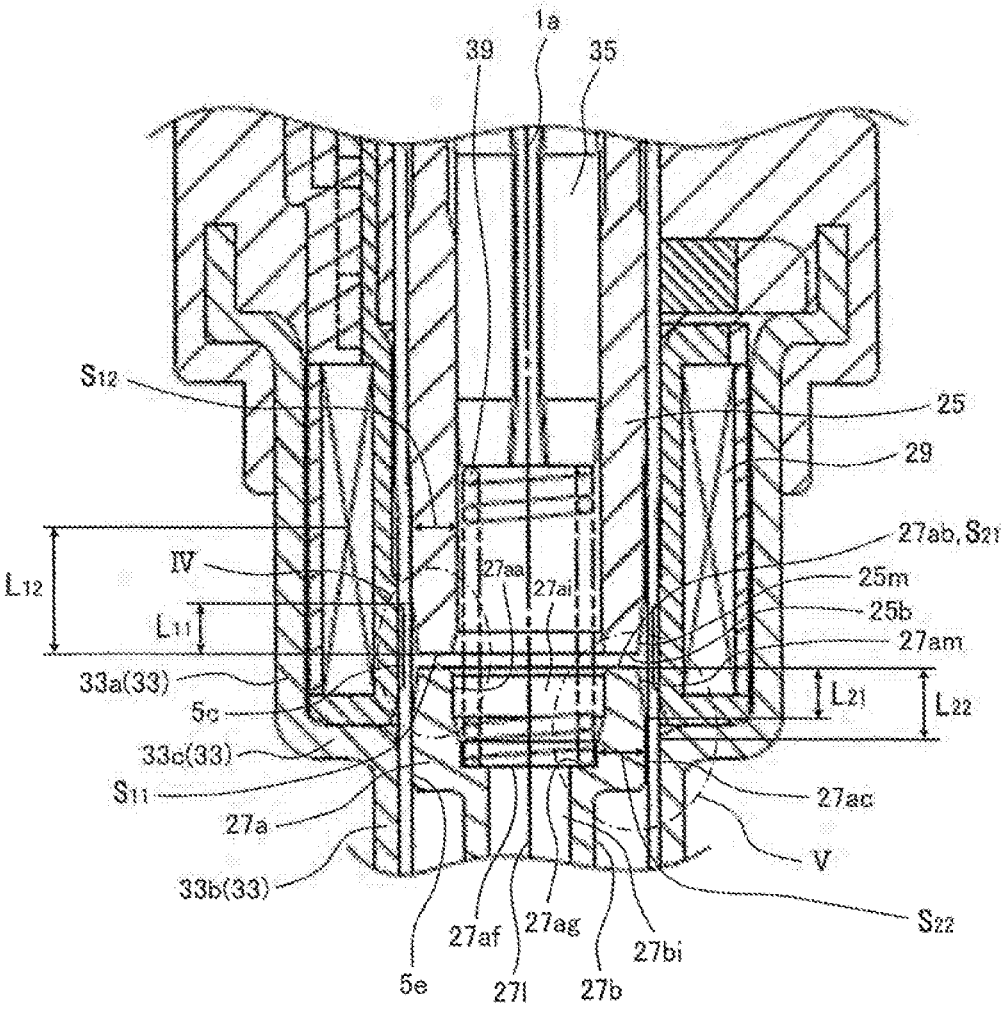
FIG. 3 is an enlarged sectional view showing the enlarged vicinity of a movable iron core 27*a* and a fixed iron core 25 shown in FIG. 1.
Figure 4:
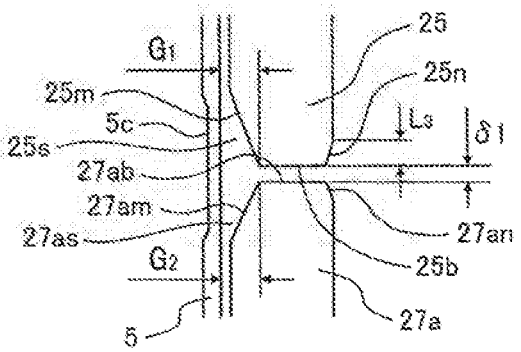
FIG. 4 is an enlarged sectional view showing the enlarged facing part (IV part) between the movable iron core 27*a* and the fixed iron core 25 shown in FIG. 3.
Figure 5:
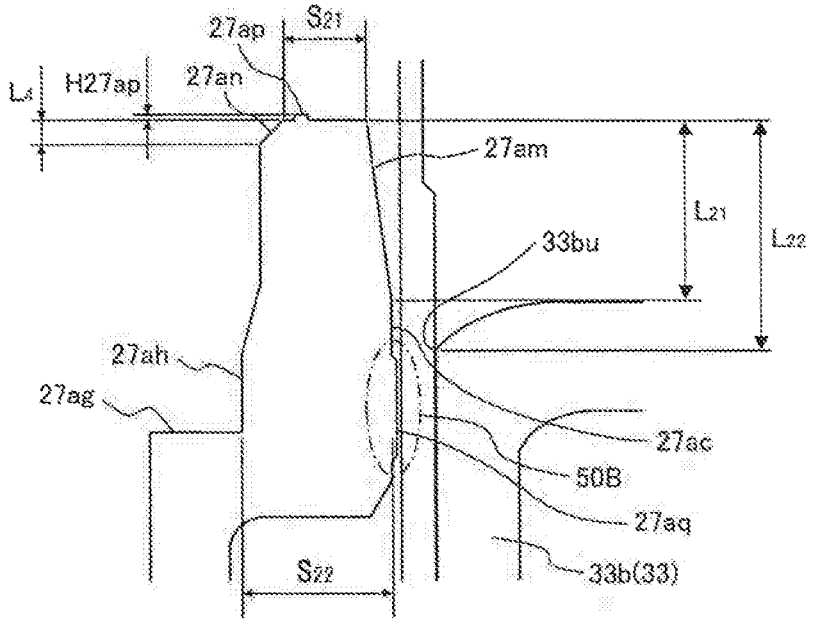
FIG. 5 is an enlarged sectional view showing the enlarged vicinity (V part) of the movable iron core 27*a* shown in FIG. 3.

In FIG. 3 to FIG. 5, a dimension of each part is defined, as follows. In addition, the following dimensions are defied with the position of the movable element 27 at the time of the valve closing as a reference.

$S_{11}$: The area of the facing end surface 25*b* of the fixed iron core 25 which faces the movable iron core 27*a*.

$S_{12}$: The sectional area of the fixed iron core 25 at the center position of the coil 29 in the direction along the central axis 1*a*.

$L_{11}$: The length of the tapered surface 25*m* of the fixed iron core 25 in the direction along the central axis 1*a*.

$L_{12}$: The length from the center position of the coil 29 in the direction along the central axis 1*a* to the facing end surface 25*b* of the fixed iron core 25 which faces the movable iron core 27*a*.

$L_3$: The length of the inclined surface 25*n* of the fixed iron core 25 in the direction along the central axis 1*a*.

$S_{21}$: The area of the facing end surface 27*ab* of the movable iron core 27*a* which faces the fixed iron core 25.

$S_{22}$: The maximum sectional area (sectional area perpendicular to the central axis 1*a*) of the movable iron core 27*a* within the range facing the inner circumferential surface 5*e* of the cylindrical body 5.

$L_{21}$: The length of the tapered surface 27*am* of the movable iron core 27*a* in the direction along the central axis 1*a*.

$L_{22}$: The length from the upper end position of the joint part of the yoke 33 and the cylindrical body 5 to the facing end surface 27*ab* of the movable iron core 27*a* which faces the fixed iron core 25.

$L_4$: The length of the inclined surface 27*an* of the movable iron core 27*a* in the direction along the central axis 1*a*.

δ1: The gap length between the end surface 25*b* of the fixed iron core 25 and the end surface 27*ab* of the movable iron core 27*a* which face each other. This gap length is equal to the maximum gap length at the time of the valve closing, that is, equal to the gap between the magnetic bodies at the time of the valve closing.

$G_1$: The gap length formed between the outer circumference of the facing end surface 25*b* of the fixed iron core 25 and the inner circumferential surface 5*e* of the cylindrical body 5. This gap length $G_1$ is a length in the radial directions of the fixed iron core 25 and the inner circumferential surface 5*e* of the cylindrical body 5.

$G_2$: The gap length formed between the outer circumference of the facing end surface 27*ab* of the movable iron core 27*a* and the inner circumferential surface 5*e* of the cylindrical body 5. This gap length $G_2$ is a length in the radial directions of the movable iron core 27*a* and the inner circumferential surface 5*e* of the cylindrical body 5.

However, in the definitions of the above dimensions, it is necessary that the following points are taken into consideration.

As shown in FIG. 5, there is a case where a convex portion 27*ap* is formed on the facing end surface 27*ab* of the movable iron core 27*a* which faces the fixed iron core 25. The convex portion 27*ap* is provided to prevent the sticking of the facing end surface 27*ab* of the movable iron core 27*a* to the facing end surface 25*b* of the fixed iron core 25. A height H27*ap* of the convex portion 27*ap* is usually 50 μm or less. In this case, the area $S_{21}$, the length $L_{21}$ and the length $L_{22}$ are defined without including the convex portion 27*ap*. That is, when the facing end surface 27*ab* is projected on a plane surface perpendicular to the central axis 1*a*, the area $S_{21}$ is defined as a projected area surrounded by the inner circumferential edge (inner diameter) and the outer circumferential edge (outer diameter) of the facing end surface 27*ab*. In addition, each of the length $L_{21}$ and the length $L_{22}$ is a length reaching the facing end surface 27*ab* without including the convex portion 27*ap*.

There is a case where the convex portion 27*ap* is provided on the facing end surface 25*b* of the fixed iron core 25 instead of the facing end surface 27*ab* of the movable iron core 27*a*. In this case, the area $S_{11}$, the length $L_{11}$ and the $L_{12}$ are defined without including the convex portion 27*ap*, similar to the length $L_{21}$ and the length $L_{22}$ in the movable iron core 27*a*.

As shown in FIG. 5, there is a case where a convex portion 27*aq* is provided on the outer circumferential surface 27*ac* of the movable iron core 27*a* which faces the inner circumferential surface 5*e* of the cylindrical body 5. The convex portion 27*aq* forms a sliding portion which slides with the inner circumferential surface 5*e* of the cylindrical body 5. In this case, the sectional area of the convex portion 27*aq* is not included into the sectional area $S_{22}$.

Figure 6:
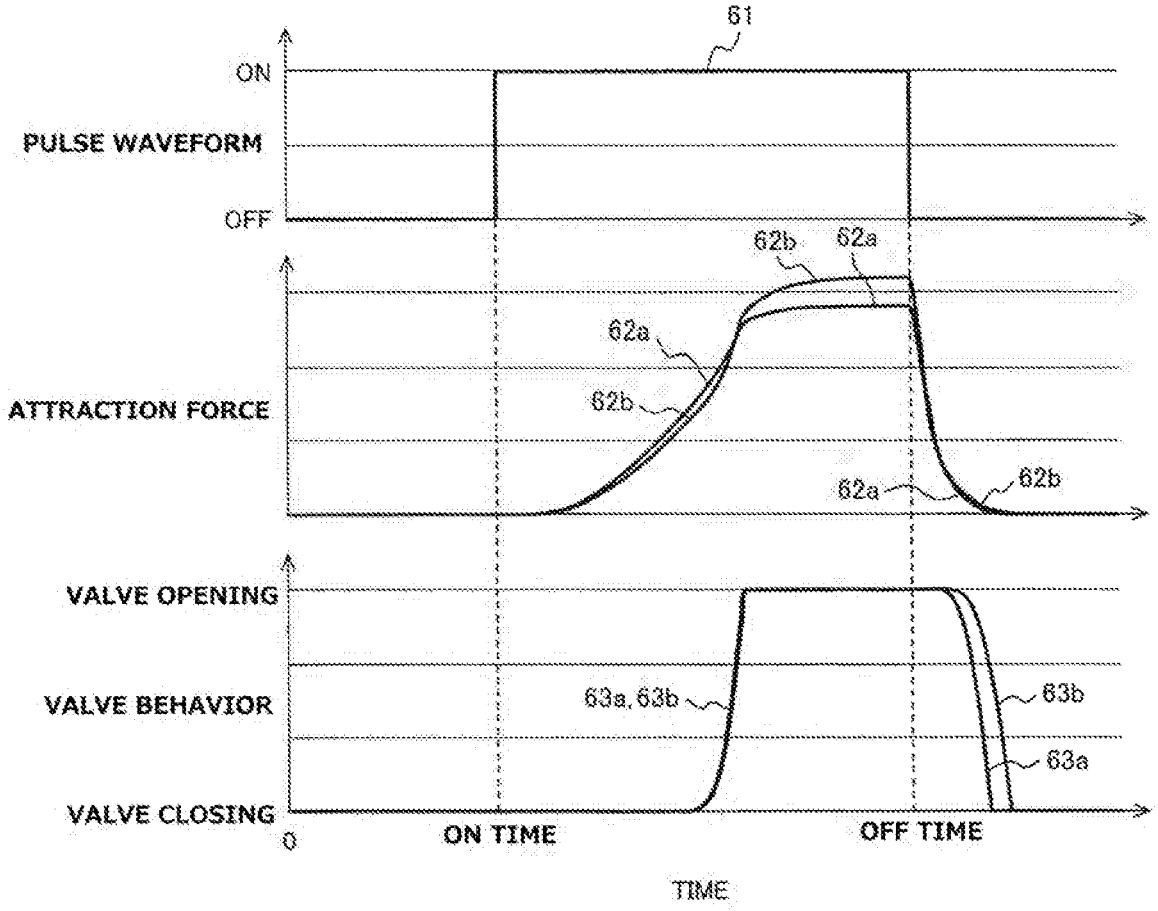
FIG. 6 is a response waveform diagram showing a response of each of attraction force and valve behavior to pulse waveform in one embodiment of the present invention.

Next, working effects of the tapered surface 25*m* of the fixed iron core 25 and the tapered surface 27*am* of the movable iron core 27*a* will be explained with reference to FIG. 6. FIG. 6 is a response waveform diagram showing a response of each of attraction force and valve behavior to pulse waveform in one embodiment of the present invention.

FIG. 6 shows a pulse 61 which is switched from an off-state to an on-state in accordance with an injection time of the fuel, attraction forces (magnetic attraction force) 62*a* and 62*b* applied to the movable iron core 27*a* (movable element 27) in accordance with the pulse 61 and behaviors (valve behavior) 63*a* and 63*b* of the movable element 27 driven by the attraction forces (magnetic attraction force) 62*a* and 62*b*. The attraction force 62*a* and the valve behavior 63*a* show a feature of the present embodiment in which the tapered surface 25*m* and the tapered surface 27*am* are provided to the fixed iron core 25 and the movable iron core 27*a* respectively. The attraction force 62*b* and the valve behavior 63*b* show a feature of a comparative embodiment (for example, the configuration shown in FIG. 10) compared with the present invention, comparative embodiment in which the tapered surface 25*m* and the tapered surface 27*am* are not provided to the fixed iron core 25 and the movable iron core 27*a* respectively. In addition, in the diagram of the valve behavior, "valve opening" means a state (position) in which the movable element 27 is lifted by the maximum stroke and the valve is opened. Specifically, it is in a state (position) in which the end surface 27*ab* of the movable iron core 27*a* comes into contact with the end surface 25*b* of the fixed iron core 25.

(1) Improvement of valve opening response

By providing the tapered surface 25*m* and the tapered surface 27*am* to the fixed iron core 25 and the movable iron core 27*a* respectively, a rise of the attraction force 62*a* of the present embodiment can be improved as compared with a rise of the attract ion force 62*b* of the comparative embodiment.

This means that by setting the area $S_{11}$ of the facing end surface 25*b* of the fixed iron core 25 and the area $S_{21}$ of the facing end surface 27*ab* of the movable iron core 27*a* which face each other to be smaller than the maximum sectional area of the fixed iron core 25 and the maximum sectional area $S_{22}$ of the movable iron core 27*a* respectively, a magnetic flux is concentrated on the facing surfaces of the fixed iron core 25 and the movable iron core 27*a* at the time of lower voltage (at the time of the minimum drive voltage), and thereby the magnetic attraction force can be increased. It leads to shortening of a period of valve opening operation time from a state of the valve closing to a state of the valve opening. That is, the response at the time of the valve opening is improved.

If the magnetic attraction force at the time of low voltage is increased, the set load of the coil spring 39 can be set large.

The valve behavior 63*a* of FIG. 6 shows a valve behavior in a state in which the set load of the coil spring 39 is set larger, as compared with the valve behavior 63*b*. Therefore there exists no difference between a rise of the valve behavior 63*a* and a rise of the valve behavior 63*b*. However, by setting the set load of the coil spring 39 larger, the valve behavior 63*b* at the time of the after-mentioned valve closing can be improved. If the set load of the coil spring 39 is set equal to the set load in the valve behavior 63*b*, a rise of the valve behavior 63*a* is improved and becomes faster.

(2) Improvement of valve closing response

By providing the tapered surface 25*m* and the tapered surface 27*am* to the fixed iron core 25 and the movable iron core 27*a* respectively, the area $S_{11}$ of the facing end surface 25*b* of the fixed iron core 25 and the area $S_{21}$ of the facing end surface 27*ab* of the movable iron core 27*a* which face each other can be small, and consequently, the maximum magnetic flux quantum (saturation magnetic flux quantum) is suppressed and can be small.

By making the maximum magnetic flux small, the maximum attraction force can be small, and it is possible to shorten demagnetization time at the time when the energization of the coil 29 is switched to an off-state (pulse 61 is in an off-state). Consequently, the elimination of the attraction force 62*a* can be performed quicker than that of the attraction force 62*b*. This loads to shortening of a period of valve closing operation time from a state of the valve opening to a state of the valve closing. That is, the response at the time of the valve closing is improved.

Moreover, as mentioned above, by setting the set load of the coil spring 39 large, as compared with a case of the comparative embodiment, the movable element 27 that lost the magnetic attraction force quickly becomes the valve closing state. In FIG. 6, it has been shown that the reducing effect of the maximum magnetic flux quantum and the increasing effect of the set load of the coil spring 39 are combined, and the valve behavior 63*a* of the present embodiment becomes the valve closing state quicker than the valve behavior 63*b* of the comparative embodiment.

As explained above, in the fuel injection valve of the present embodiment, by providing the tapered surface 25*m* and the tapered surface 27*am* to the fixed iron core 25 and the movable iron core 27*a* respectively, the magnetic flux can be concentrated to each of the facing end surface 25*b* of the fixed iron core 25 and the facing end surface 27*ab* of the movable iron core 27*a*. In particular, the tapered surface 25*m* and the tapered surface 27*am* are provided on the outer circumferential surface side of the fixed iron core 25 and on the outer circumferential surface side of the movable iron core 27*a* respectively, and the magnetic flux passing near each of the outer circumferential surfaces of the fixed iron core 25 and the movable iron core 27*a* can be directed radially inside, and consequently, the magnetic flux can be efficiently concentrated on each of the facing end surface 25*b* of the fixed iron core 25 and the facing end surface 27*ab* of the movable iron core 27*a*. Accordingly, the response at the time of the valve opening and the valve closing of the fuel injection valve of the present embodiment can be improved.

In the present embodiment, the range of each of the above dimensions defined in FIG. 3 to FIG. 5 is set, as follows.

The length $L_{11}$ of the tapered surface 25*m* of the fixed iron core 25 is set in the range of $L_3 \leq L_{11} \leq L_{12}$. The upper limit of $L_{11}$ is set to $L_{12}$ because a magnetic field becomes the strongest in the central position of the coil 29 in the direction along the central axis 1*a*. In addition, the chamfer dimension $L_3$ is usually smaller than 0.3 mm. The length $L_{11}$ is therefore set in the range of 0.3 mm$\leq L_{11} \leq L_{12}$.

The length $L_{21}$ of the tapered surface 27*am* of the movable iron core 27*a* is set in the range of $L_4 \leq L_{21} \leq L_{22}$. If the length of $L_{21}$ is set longer than that of $L_{22}$, magnetic resistance increases because the magnetic path formed between the yoke 33 and the movable iron core 27*a* is formed so as to bypass the gap formed by the tapered surface 27*am*. By setting the length of $L_{21}$ to the range of $L_{21} \leq L_{22}$, the magnetic path formed between the yoke 33 and the movable iron core 27*a* becomes liner, and the increase of the magnetic resistance can be prevented. In addition, the chamfer dimension $L_4$ is usually smaller than 0.3 mm. The length $L_{21}$ is therefore set in the range of 0.3 mm$\leq L_{21} \leq L_{22}$.

The length $G_1$ of the gap formed between the outer circumference of the end surface 25*b* of the fixed iron core 25 and the inner circumferential surface 5*e* of the cylindrical body 5 is preferably set in the range of $\delta 1 \leq G_1$. In addition, the length $G_2$ of the gap formed between the outer circumference of the end surface 27*ab* of the movable iron core 27*a* and the inner circumferential surface 5*e* of the cylindrical body 5 is preferably set in the range of $\delta 1 \leq G_2$. By setting each of the gap length $G_1$ and the gap length $G_2$ to be equal to or longer than that of the gap δ1, it is possible to suppress the magnetic flax from leaking from the facing part (gap δ1 part) to the valve body 5 side, facing part at which the fixed iron core 25 and the movable iron core 27*a* face each other.

The area $S_{11}$ of the facing end surface 25*b* of the fixed iron core 25 is preferably set in the range of $0.5 \leq S_{11}/S_{12} \leq 0.8$. In addition, the area $S_{21}$ of the facing end surface 27*ab* of the movable iron core 27*a* is preferably set in the range of $0.5 \leq S_{21}/S_{22} \leq 0.8$. With this, the magnetic flux can be efficiently concentrated to each of the facing end surface 25*b* of the fixed iron core 25 and the facing end surface 27*ab* of the movable iron core 27*a*.

The outer diameter of the facing end surface 25*b* of the fixed iron core 25 is equal to that of the facing end surface 27*ab* of the movable iron core 27*a*. With this, the magnetic flux can be efficiently concentrated to each of the facing end surface 25*b* of the fixed iron core 25 and the facing end surface 27*ab* of the movable iron core 27*a*.

Figure 10:
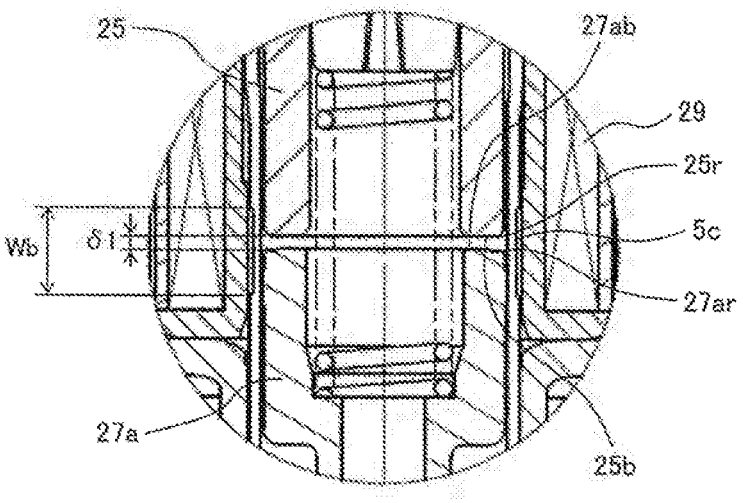
FIG. 10 is an enlarged sectional view showing an enlarged facing part at which the movable iron core 27*a* faces the fixed iron core 25, in a comparative embodiment compared with the present invention.

Here, the differences between the tapered surface 25*m* of the present embodiment and a chamfered part 25*r* of the comparative embodiment and between the tapered surface 27*am* of the present embodiment and a chamfered part 27*ar* of the comparative embodiment will be explained with reference to FIG. 10. FIG. 10 is an enlarged sectional view showing an enlarged facing part at which the movable iron core 27*a* and the fixed iron core 25 face each other, in the comparative embodiment compared with the present invention.

The chamfered part (inclined surface) 25*r* is usually provided at the outer circumferential part of the facing end surface 25*b* of the fixed iron core 25. In addition, the chamfered part (inclined surface) 27*ar* is usually provided at the outer circumferential part of the facing end surface 27*ab* of the movable iron core 27*a*. The chamfered parts 25*r* is provided such that the shape and the dimension thereof are set similar to those of the chamfered part (inclined part) 25*n*, and the chamfered part 27*ar* is provided such that the shape and the dimension thereof are set similar to those of chamfered part (inclined surface) 27*an* shown in FIG. 4 and FIG. 5. That is, the chamfered parts 25*r* and 27*ar* are provided such that the length of the chamfered part 25*r* and the length of the chamfered part 27*ar* in the directions along the central axes 1*a* and 27*l* are the same as the length $L_3$ of the chamfered part (inclined surface) 25*n* and the length $L_4$ of the chamfered part (inclined surface) 27*an* shown in FIG. 4 and FIG. 5 respectively. In addition, each of the chamfered parts 25*r* and 27*ar* is usually provided at the angle of 45 degrees relative to the central axis 1*a*, and the dimension of the chamfered part 25*r* and the dimension of the chamfered part 27*ar* in the radial direction are the same as the length $L_3$ and the length $L_4$ respectively. However, it is not possible to obtain a practical effect of concentrating the magnetic flux to each of the facing end surface 25*b* of the fixed iron core 25 and the facing end surface 27*ab* of the movable iron core 27*a* with these chamfered parts 25*r* and 27*ar* provided within such a minute range.

In the present embodiment, each of the length $L_{11}$ and the length $L_{12}$ of the tapered surface 25*m* is practically longer than the length dimension $L_3$ of the chamfered part 25*r*, and each of the length $L_{21}$ and the length $L_{22}$ of the tapered surface 27*am* is practically longer than the length dimension $L_4$ of the chamfered part 27*ar*. Here, a dimension practically longer than the dimension of each of the length $L_3$ of the chamfered part 25*r* and the length $L_4$ of the chamfered part 27*a* is, as mentioned above, a length dimension with which a practical effect of concentrating the magnetic flux to each of the facing end surface 25*b* of the fixed iron core 25 and the facing end surface 27*ab* of the movable iron core 27*a* can be obtained.

Figure 7:
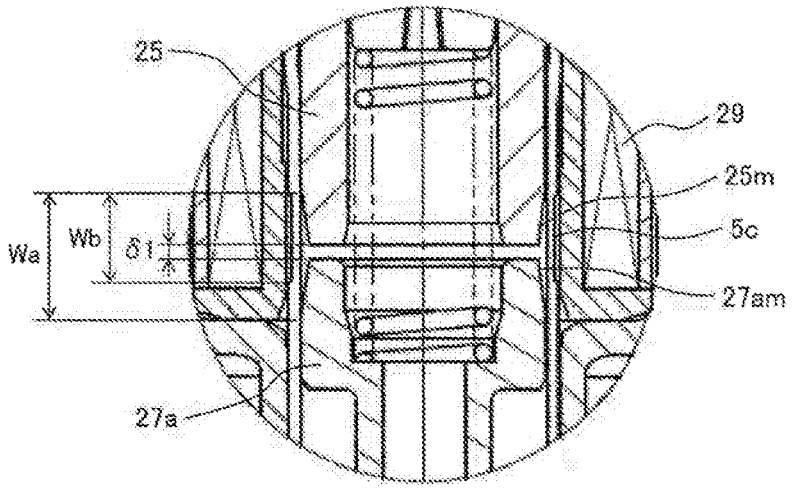
FIG. 7 is a sectional view to explain a tapered surface 27*am* of the movable iron core 27*a* and a tapered surface 25*m* of the fixed iron core 25.

Here, the tapered surface 25*m* of the fixed iron core 25 and the tapered surface 27*am* of the movable iron core 27*a* will be additionally explained with reference to FIG. 7. FIG. 7 is a sectional view to explain the tapered surface 27*am* of the movable iron core 27*a* and the tapered surface 25*m* of the fixed iron core 25.

In the present embodiment, at the time of the valve opening (state in which the valve body 27*c* comes into contact with the valve seat 15*b*), a space (length in the central axis 1*a* direction) Wa between the upper end part (end part on the anti-movable iron core side) of the tapered surface 25*m* and the lower end part (end part on the anti-fixed iron core side) of the tapered surface 27*am* is set longer than a length Wb of the nonmagnetic part 5*c* in the central axis 1*a* direction.

In addition, the upper end part of the tapered surface 25*m* is positioned on the upper side from the upper end part of the nonmagnetic part 5*c*, and at least at the valve opening time, the lower end part of the tapered surface 27*am* is positioned on the lower side from the lower end part of the nonmagnetic part 5*c*.

With this, the reduction effect of the leakage magnetic flux by the nonmagnetic part 5*c* formed in the cylindrical body 5 can be enhanced with the tapered surface 25*m* and the tapered surface 27*am*.

Figure 8:
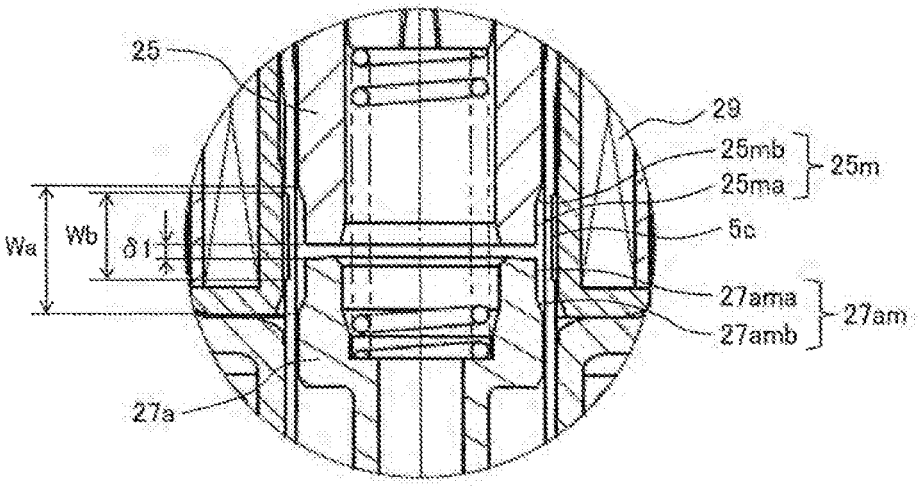
FIG. 8 is a sectional view showing a variation of each of the tapered surface 27*am* of the movable iron core 27*a* and the tapered surface 25*m* of the fixed iron core 25.

Next, a variation of each of the tapered surface 25*m* of the fixed iron core 25 and the tapered surface 27*am* of the movable iron core 27*a* will be explained with reference to FIG. 8. FIG. 8 is a sectional view showing the variation of each of the tapered surface 27*am* of the movable iron core 27*a* and the tapered surface 25*m* of the fixed iron core 25.

In the present variation, the magnetic throttling part 25*m* is formed by using a cylindrical surface 25*ma* instead of the tapered surface 25*m* of the fixed iron core 25. In addition, the magnetic throttling part 27*am* is formed by using a cylindrical surface 27*ama* instead of the tapered surface 27*am* of the movable iron core 27*a*. The cylindrical surface 25*ma* and the cylindrical surface 27*ama* are each formed by a cylindrical surface parallel to the inner circumferential surface 5*e* of the cylindrical body 5.

The cylindrical surface 25*ma* forms a reduced-diameter part formed by reducing the outer diameter of the fixed iron core 25 to form the magnetic throttling part 25*m*. In addition, the cylindrical surface 27*ama* forms a reduced-diameter part formed by reducing the outer diameter of the movable iron core 27*a* to form the magnetic throttling part 27*am*.

An inclined surface (tapered surface) 25*mb* which connects the cylindrical surface 25*ma* with the outer circumferential surface part which becomes the maximum diameter of the fixed iron core 25 is formed on the anti-movable iron core side of the cylindrical surface 25*ma*. That is, the inclined surface 25*mb* is formed between the large diameter part formed on the anti-movable iron core side of the cylindrical surface (reduced-diameter part) 25*ma* of the fixed iron core 25 and the cylindrical surface 25*ma*, inclined surface 25*mb* in which the outer diameter of the fixed iron core 25 is reduced in a tapered shape from the large diameter part toward the cylindrical surface 25*ma*.

An inclined surface (tapered surface) 27*amb* which connects the cylindrical surface 27*ama* with the outer circumferential surface part which becomes the maximum diameter of the movable iron core 27*a* is formed on the anti-fixed iron core side of the cylindrical surface 27*ama*. That is, the tapered surface is formed between the large diameter part formed on the anti-fixed iron core side of the cylindrical surface (reduced-diameter part) 27*ama* of the movable iron core 27*a* and the cylindrical surface 27*ama*, tapered surface in which the outer diameter of the movable iron care 27*a* is reduced in a tapered shape from the large diameter part toward the cylindrical surface 27*ama*.

The cylindrical surface 25*ma* and the inclined surface 25*mb* form the reduced-diameter part, and then the magnetic throttling part 25*m* is formed. The cylindrical surface 27*ama* and the inclined surface 27*amb* form the reduced-diameter part, and then the magnetic throttling part 27*am* is formed.

The cylindrical surface 25*ma* and the cylindrical surface 27*ama* are parallel to each other. In addition, the cylindrical surface 25*ma* is parallel to the inner circumferential surface 5*e* of the cylindrical body 5, and the cylindrical surface 27*ama* is parallel to the inner circumferential surface 5*e* of the cylindrical body 5.

In the present variation, the same effect as the tapered surface 25*m* formed on the outer circumferential part of the fixed iron core 25 can be also obtained by the cylindrical surface 25*ma* and the inclined surface 25*mb* formed on the outer circumferential part of the fixed iron core 25. In addition, the same effect as the tapered surface 27*am* formed on the outer circumferential part of the movable iron core 27*a* can be obtained by the cylindrical surface 27*ama* and the inclined surface 27*amb* formed on the outer circumferential part of the movable iron core 27*a*.

However, since the cylindrical surface 25*ma* and the cylindrical surface 27*ama* are parallel to each other, as compared with a case of the tapered surface 25*m* and the tapered surface 27*am*, in the facing end surface 25*b* part of the fixed iron core 25 and the facing end surface 27*ab* part of the movable iron core 27*a*, there is possibility that the effect of directing the magnetic flux radially inward is reduced.

In the present variation, the dimension of each part is also defined as mentioned above.

In the present variation, either the magnetic throttling part 25*m* or the magnetic throttling part 27*am* can be formed by the tapered surface explained in FIG. 3 to FIG. 5.

Figure 9:
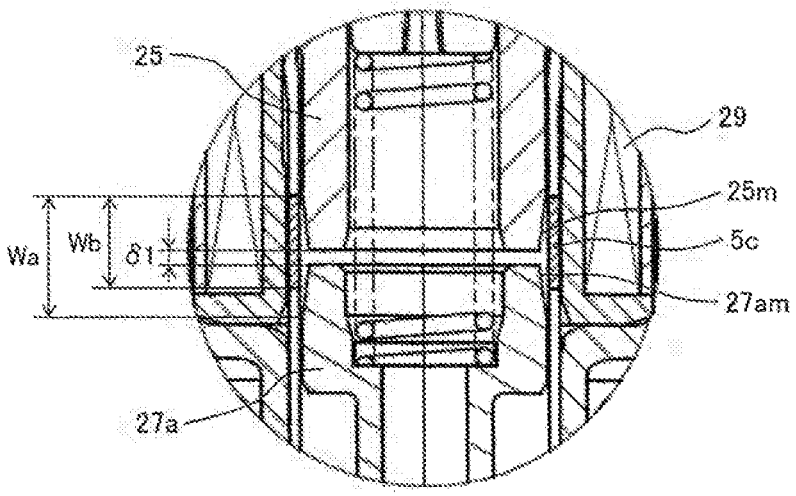
FIG. 9 is a sectional view showing a variation in which the configuration of a nonmagnetic part 5*c* is varied with respect to FIG. 3.

Next, a variation of the nonmagnetic part 5*c* will be explained with reference to FIG. 9. FIG. 9 is a sectional view showing the variation in which the configuration of the nonmagnetic part 5*c* is varied when compared with that of the nonmagnetic part 5*c* of FIG. 3.

In the present embodiment, the nonmagnetic part 5*c* is formed by using a nonmagnetic material or a weak magnetic material. In the variation, the dimension relation between Wa and Wb explained in FIG. 7 is also applied.

In addition, either or both of the magnetic throttling part 25*m* and the magnetic throttling part 27*am* may be formed by using cylindrical surfaces 25*ma* and 27*ama* respectively.

The cylindrical body 5 may be formed of a plurality of members by using a nonmagnetic material or a weak magnetic material to the nonmagnetic part 5*c* like the present variation, or may be formed of one member made of a magnetic material, including the nonmagnetic part 5*c*, like the above-mentioned embodiment.

Figure 11:
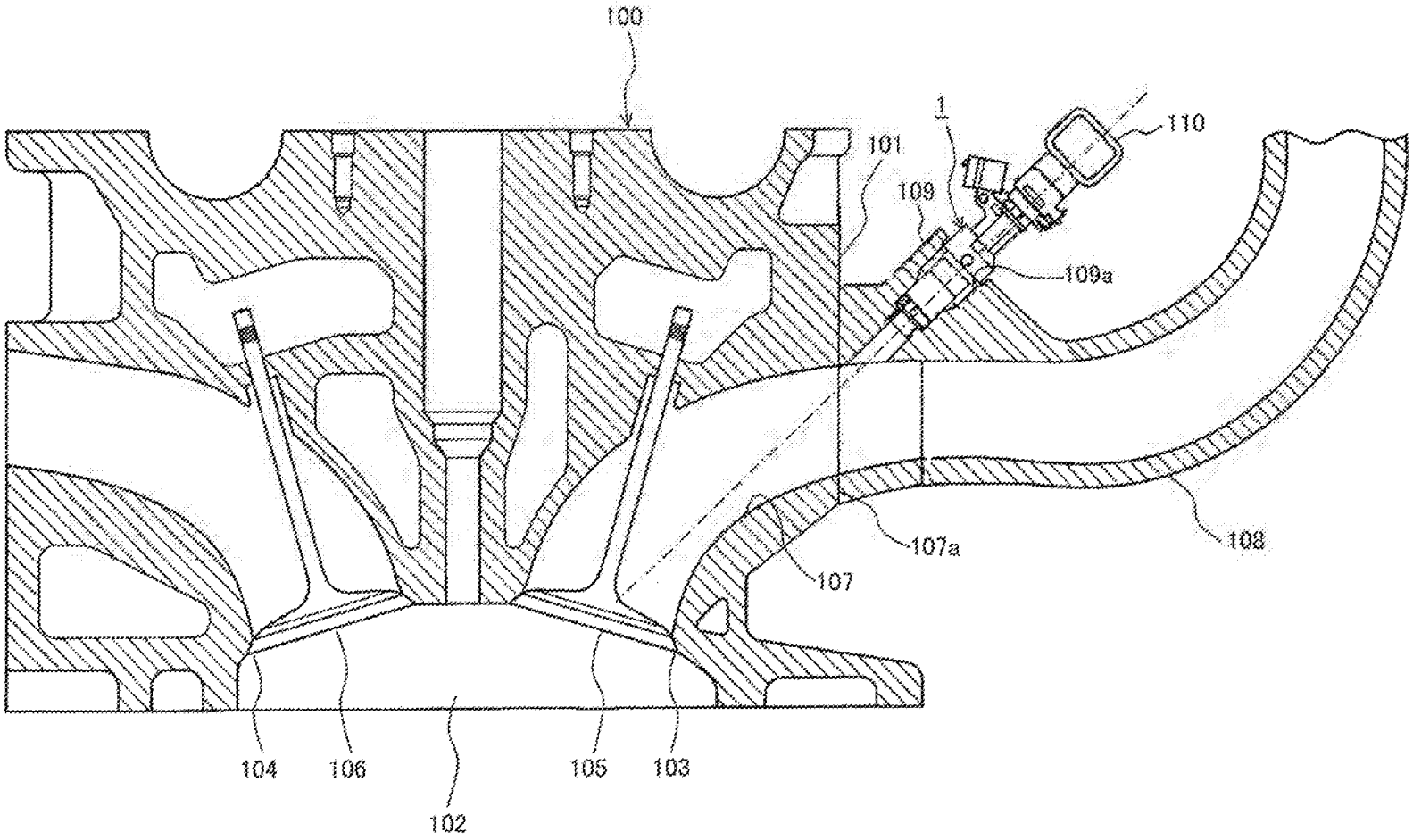
FIG. 11 is a sectional view of an internal combustion engine on which a fuel injection valve 1 is mounted.

An internal combustion engine on which the fuel injection valve 1 according to the present invention is mounted will be explained with reference to FIG. 11. FIG. 11 is a sectional view of the internal combustion engine on which the fuel injection valve 1 is mounted.

An engine block 101 of an internal combustion engine 100 is formed with a cylinder 102, and an intake port 103 and an exhaust port 104 are provided at the top part of the cylinder 102. The intake port 103 is provided with an intake valve 105 that opens and closes the intake port 103, and the exhaust port 104 is provided with an exhaust valve 106 that opens and closes the exhaust port 104. An intake pipe 108 is connected to an inlet side end part 107*a* of an intake flow passage 107 formed in the engine block 101 and communicating to the intake port 103.

A fuel pipe 110 is connected to the fuel supply port 2 (see FIG. 1) of the fuel injection valve 1.

The intake pipe 108 is formed with an attaching part 109 for the fuel injection valve 1, and the attaching part 109 is formed with an insertion port 109*a* into which the fuel injection valve 1 is inserted. The insertion port 109*a* penetrates to the inner wall surface of the intake pipe 108 (intake flow passage), and the fuel injected from the fuel injection valve 1 inserted into the insertion port 109*a* is injected into the intake flow passage. In a case of two-directional spray, in an internal combustion engine in which two intake ports 103 are provided in the engine block 101, fuel injection sprays are injected toward the respective intake ports 103 (intake valves 105).

In addition, the present invention is not limited to the above embodiment, and a part of the configuration can be deleted and another configuration which is not described can be added. Moreover, as to the configuration described in the explanation of each of the embodiment and its variations mentioned above, they can be applied to each other within a range in which they are not inconsistent with each other.

As a fuel injection valve based on the embodiment explained above, for example, the following aspects can be considered.

That is, in one aspect of the fuel injection valve, it includes: a valve seat and a valve body that cooperatively open and close a fuel passage; a movable element including the valve body provided at one end part thereof and a movable iron core provided at the other end part thereof; a fixed iron core which faces the movable iron core and which attracts the movable iron core by applying a magnetic attraction force to the movable iron core; and a cylindrical member including thereinside the fixed iron core and the movable iron core, wherein the fixed iron core includes a reduced-diameter part on an outer circumferential surface at a side facing the movable iron core, and wherein the movable iron core includes a reduced-diameter part on an outer circumferential surface at a side facing the fixed iron core.

In a preferable aspect of the fuel injection valve, an outer diameter of a facing end surface of the fixed iron core, the facing end surface which faces the movable iron core, is equal to an outer diameter of a facing end surface of the movable iron core, the facing end surface which faces the fixed iron core.

In another preferable aspect, in any of the aspects of the fuel injection valve, the reduced-diameter part, of the fixed iron core is formed in a tapered shape such that an outer diameter of the fixed iron core is gradually reduced toward the movable iron core.

In yet another preferable aspect, in any of the aspects of the fuel injection valve, the reduced-diameter part of the fixed iron core is formed by a cylindrical surface parallel to an inner circumferential surface of the cylindrical member.

In yet another preferable aspect, in any of the aspects of the fuel injection valve, a tapered surface in which an outer diameter of the fixed iron core is reduced in a tapered shape from a large diameter part formed on an anti-movable iron core side of the reduced-diameter part of the fixed iron core toward the cylindrical surface is formed between the large diameter part and the cylindrical surface.

In yet another preferable aspect, in any of the aspects of the fuel injection valve, the reduced-diameter part of the movable iron core is formed in a tapered shape such that an outer diameter of the movable iron core is gradually reduced toward the fixed iron core.

In yet another preferable aspect, in any of the aspects of the fuel injection valve, the reduced-diameter part of the movable iron core is formed by a cylindrical surface parallel to an inner circumferential surface of the cylindrical member.

In yet another preferable aspect, in any of the aspects of the fuel injection valve, a tapered surface in which an outer diameter of the movable iron core is reduced in a tapered shape from a large diameter part formed on an anti-fixed iron core side of the reduced-diameter part of the movable iron core toward the cylindrical surface is formed between the large diameter part and the cylindrical surface.

In yet another preferable aspect, in any of the aspects of the fuel injection valve, the fixed iron core includes a chamfer at an inner circumferential edge of a facing end surface thereof which faces the movable iron core, the movable iron core includes a chamfer at an inner circumferential edge of a facing end surface thereof which faces the fixed iron core, and a length dimension of the reduced-diameter part of the fixed iron core in a direction along a central axis of the fuel injection valve is larger than each of a length dimension of the chamfer formed in the fixed iron core and a length dimension of the chamfer formed in the movable iron core in the direction along the central axis.

In yet another preferable aspect, in any of the aspects of the fuel injection valve, the cylindrical member is formed of a magnetic material and provided with a nonmagnetic part or a weak magnetic part at an outer circumferential part of a facing part at which the facing end surface of the fixed iron core and the facing end surface of the movable iron core face each other, the reduced-diameter part of the movable iron core is formed such that a length dimension of the reduced-diameter part in a direction along a central axis of the movable element is larger than each of the length dimension of the chamfer formed in the fixed iron core and the length dimension of the chamfer formed in the movable iron core in the direction along the central axis, and in a valve closing state in which the valve body comes into contact with the valve seat, a length dimension of a space between an end part on an anti-movable iron core side of the reduced-diameter part of the fixed iron core and an end part on an anti-fixed iron core side of the reduced-diameter part of the movable iron core is larger than a length dimension of the nonmagnetic part or the weak magnetic part in the direction along the central axis of the fuel injection valve.

In yet another preferable aspect, in any of the aspects of the fuel injection valve, the fixed iron core includes a chamfer at an inner circumferential edge of a facing end surface thereof which faces the movable iron core, the movable iron core includes a chamfer at an inner circumferential edge of a facing end part thereof which faces the fixed iron core, and a length dimension of the reduced-diameter part of the movable iron core in a direction along a central axis of the movable element is larger than each of a length dimension of the chamfer formed in the fixed iron core and a length dimension of the chamfer formed in the movable iron core in the direction along the central axis.

In yet another preferable aspect, in any of the aspects of the fuel injection valve, the cylindrical member is formed of a magnetic material and provided with a nonmagnetic part or a weak magnetic part at an outer circumferential part of a facing part at which the facing and surface of the fixed iron core and the facing end surface of the movable iron core face each other, the reduced-diameter part of the fixed iron core is formed such that a length dimension of the reduced-diameter part in a direction along a central axis of the fuel injection valve is larger than each of the length dimension of the chamfer formed in the fixed iron core and the length dimension of the chamfer formed in the movable iron core in the direction along the central axis, and in a valve closing state in which the valve body comes into contact with the valve seat, a length dimension of a space between an end part on an anti-movable iron core side of the reduced-diameter part of the fixed iron core and an end part on an anti-fixed iron core side of the reduced-diameter part of the movable iron core is larger than a length dimension of the nonmagnetic part or the weak magnetic part in the direction along the central axis of the fuel injection valve.

In yet another preferable aspect, in any of the aspects of the fuel injection valve, the nonmagnetic part or the weak magnetic part of the cylindrical member is formed of a member different from that of the cylindrical member which is formed of the magnetic material.

EXPLANATION OF SIGNS

1: fuel injection valve, 1*a*: central axis, 5: cylindrical body, 5*e:* inner circumferential surface (upstream-side guide surface) of cylindrical body 5, 25: fixed iron core, 25*b:* lower end surface (end surface facing movable iron core 27*a*) of fixed iron core 25, 25*m:* magnetic throttling part or tapered surface, 25*n*: inclined surface, 25*s:* space formed between inner circumferential surface 5*e* of cylindrical body 5 and fixed iron core 25, 27: movable element, 27*a*: movable iron core, 27*ab*: upper end surface (end surface facing fixed iron core 25) of movable iron core 27*a,* 27*ac*: outer circumferential surface of movable iron core 27*a,* 27*ad*: lower end surface of movable iron core 27*a,* 27*am*: magnetic throttling part or tapered surface, 27*an*: inclined surface, 27*as*: space formed between inner circumferential surface 5*e* of cylindrical body 5 and movable iron core 27*a,* 27*c*: valve body, 27*l*: central axis of movable element 27, 33: yoke, 33*a*: large diameter part of yoke 33, 33*b*: small diameter part of yoke 33, 33*c*: stepped part of yoke 33, 50A: downstream-side guide part, 50B: upstream-side guide part.

The invention claimed is:

1. A fuel injection valve comprising:

a valve seat and a valve body that cooperatively open and close a fuel passage;

a movable element including the valve body provided at one end part thereof and a movable iron core provided at another end part thereof;

a fixed iron core disposed to face the movable iron core and to attract the movable iron core by applying a magnetic attraction force to the movable iron core; and a cylindrical member including thereinside the fixed iron core and the movable iron core, wherein the cylindrical member is formed of magnetic material and provided with a non-magnetic part or a part having weaker magnetism than the magnetic material at an outer circumferential part of a facing part at which a facing end surface of the fixed iron core and a facing end surface of the movable iron core face each other, wherein the fixed iron core includes a reduced-diameter part on an outer circumferential surface at a side facing the movable iron core, wherein the movable iron core includes a reduced-diameter part on an outer circumferential surface at a side facing the fixed iron core, wherein an end part, on a side opposite the side facing the movable iron core, of the reduced-diameter part of the fixed iron core is located closer to the side opposite the side facing the movable iron core than an end part on a side opposite the side facing the movable iron core of the non-magnetic part or the part having weaker magnetism, and wherein when the valve is opened, an end part on a side opposite the side facing the fixed iron core of the reduced-diameter part of the movable iron core is located closer to the side opposite the side facing the fixed iron core than an end part on a side opposite the side facing the fixed iron core of the non-magnetic part or the part having weaker magnetism.

2. The fuel injection valve according to claim 1, wherein an outer diameter of the facing end surface of the fixed iron core, facing the movable iron core is equal to an outer diameter of the facing end surface of the movable iron core facing the fixed iron core.

3. The fuel injection valve according to claim 1, wherein the reduced-diameter part of the fixed iron core is formed in a tapered shape such that an outer diameter of the fixed iron core is gradually reduced toward the movable iron core.

4. The fuel injection valve according to claim 1, wherein the reduced-diameter part of the fixed iron core is formed by a cylindrical surface parallel to an inner circumferential surface of the cylindrical member.

5. The fuel injection valve according to claim 4, wherein a tapered surface in which an outer diameter of the fixed iron core is reduced so as to taper from a first diameter part formed on the anti-movable iron core side of the reduced-diameter part of the fixed iron core toward the cylindrical surface is formed between the first diameter part and the cylindrical surface.

6. The fuel injection valve according to claim 1, wherein the reduced-diameter part of the movable iron core is formed in a tapered shape such that an outer diameter of the movable iron core is gradually reduced toward the fixed iron core.

7. The fuel injection valve according to claim 1, wherein the reduced-diameter part of the movable iron core is formed by a cylindrical surface parallel to an inner circumferential surface of the cylindrical member.

8. The fuel injection valve according to claim 7, wherein a tapered surface in which an outer diameter of the movable iron core is reduced so as to taper from a first diameter part formed on the anti-fixed iron core side of the reduced-diameter part of the movable iron core toward the cylindrical surface is formed between the first diameter part and the cylindrical surface.

9. The fuel injection valve according to claim 1, wherein:

the fixed iron core includes a chamfer at an inner circumferential edge of the facing end surface thereof which faces the movable iron core, the movable iron core includes a chamfer at an inner circumferential edge of the facing end surface thereof which faces the fixed iron core, and a length of the reduced-diameter part of the fixed iron core in a direction along a central axis of the fuel injection valve is larger than each of a length of the chamfer formed in the fixed iron core and a length of the chamfer formed in the movable iron core in the direction along the central axis.

10. The fuel injection valve according to claim 9, wherein:

the reduced-diameter part of the movable iron core is formed such that a length of the reduced-diameter part in a direction along a central axis of the movable element is larger than each of the length of the chamfer formed in the fixed iron core and the length of the chamfer formed in the movable iron core in the direction along the central axis, and in a valve closing state in which the valve body comes into contact with the valve seat, a length of the a space between the end part on an anti-movable iron core side of the reduced-diameter part of the fixed iron core and the end part on the anti-fixed iron core side of the reduced-diameter part of the movable iron core is larger than a length of the non-magnetic part or the part having weaker magnetism in the direction along the central axis of the fuel injection valve.

11. The fuel injection valve according to claim 1, wherein:

the fixed iron core includes a chamfer at an inner circumferential edge of the facing end surface thereof which faces the movable iron core, the movable iron core includes a chamfer at an inner circumferential edge of a facing end surface thereof which faces the fixed iron core, and a length of the reduced-diameter part of the movable iron core in a direction along a central axis of the movable element is larger than each of a length of the chamfer formed in the fixed iron core and a length of the chamfer formed in the movable iron core in the direction along the central axis.

12. The fuel injection valve according to claim 11, wherein:

the reduced-diameter part of the fixed iron core is formed such that a length of the reduced-diameter part in a direction along a central axis of the fuel injection valve is larger than each of the length of the chamfer formed in the fixed iron core and the length of the chamfer formed in the movable iron core in the direction along the central axis, and in a valve closing state in which the valve body comes into contact with the valve seat, a length a space between the end part on the anti-movable iron core side of the reduced-diameter part of the fixed iron core and the end part on the anti-fixed iron core side of the reduced-diameter part of the movable iron core is larger than a length of the non-magnetic part or the part having weaker magnetism in the direction along the central axis of the fuel injection valve.

13. The fuel injection valve according to claim 10, wherein the non-magnetic part or the part having weaker magnetism of the cylindrical member is formed of a member different from that of the cylindrical member which is formed of the magnetic material.

14. The fuel injection valve according to claim 12, wherein the non-magnetic part or the part having weaker magnetism of the cylindrical member is formed of a member different from that of the cylindrical member which is formed of the magnetic material.

15. The fuel injection valve according to claim 1, wherein the movable element comprises a valve assembly, and the cylindrical member comprises a cylindrical metallic body.

* * * * *